US006247187B1

(12) United States Patent
Chiang

(10) Patent No.: US 6,247,187 B1
(45) Date of Patent: Jun. 19, 2001

(54) SWIMMING GOGGLES FOR SWIMMING POOL PURPOSES

(76) Inventor: Herman Chiang, 27, No. 634-9, Ching-ping Rd., Chung-Ho City, Taipei Hsien (TW)

( * ) Notice: Subject to any disclaimer, the term of this patent is extended or adjusted under 35 U.S.C. 154(b) by 0 days.

(21) Appl. No.: 09/450,929

(22) Filed: Nov. 29, 1999

(51) Int. Cl.[7] ..... A61F 9/02
(52) U.S. Cl. ..... 2/428; 2/445
(58) Field of Search ..... 2/428, 430, 445, 2/426, 452; 351/43, 155, 156

(56) References Cited

U.S. PATENT DOCUMENTS 5,857,221 * 1/1999 Geneve et al. ..... 2/428
6,119,277 * 9/2000 Chiang ..... 2/428

* cited by examiner

*Primary Examiner*—Peter Nerbun
(74) *Attorney, Agent, or Firm*—Pro-Tchtor International Services

(57) ABSTRACT

A swimming goggle model, comprising: two lens frames, each lens frame accommodating a lens, and a first joining unit and a second joining unit on two opposite ends. At least one round string, pulled in sequence through the first and the second joining units of the two lens frames, maintains an appropriate span between the two lens frames. A headband device is joined in series to the two joining units on the outside edge of the two lens frames. Using this structural characteristic, the user can adjust the span of the round string between two lens frames, to adjust the span of the nose bridge.

15 Claims, 7 Drawing Sheets

PRIOR ART *FIG.1*

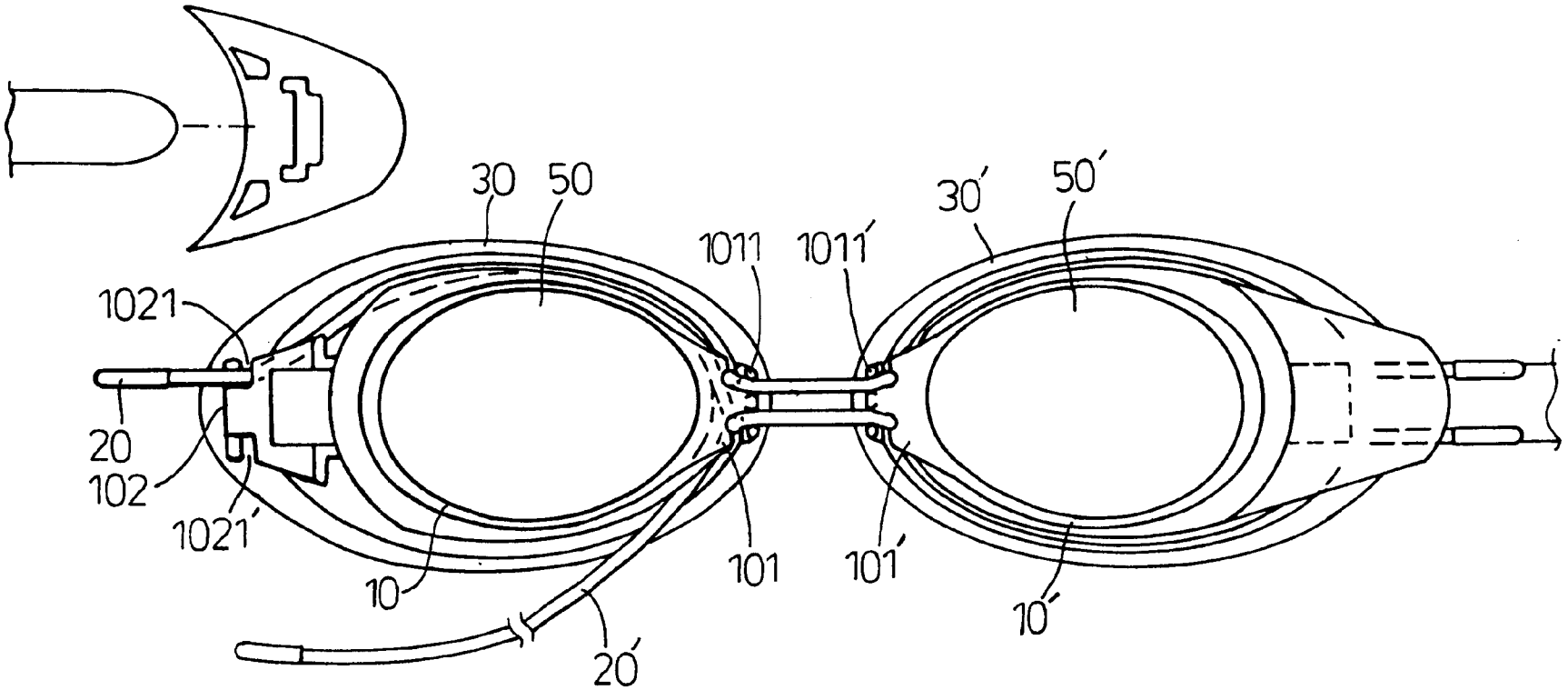
FIG.4 - A

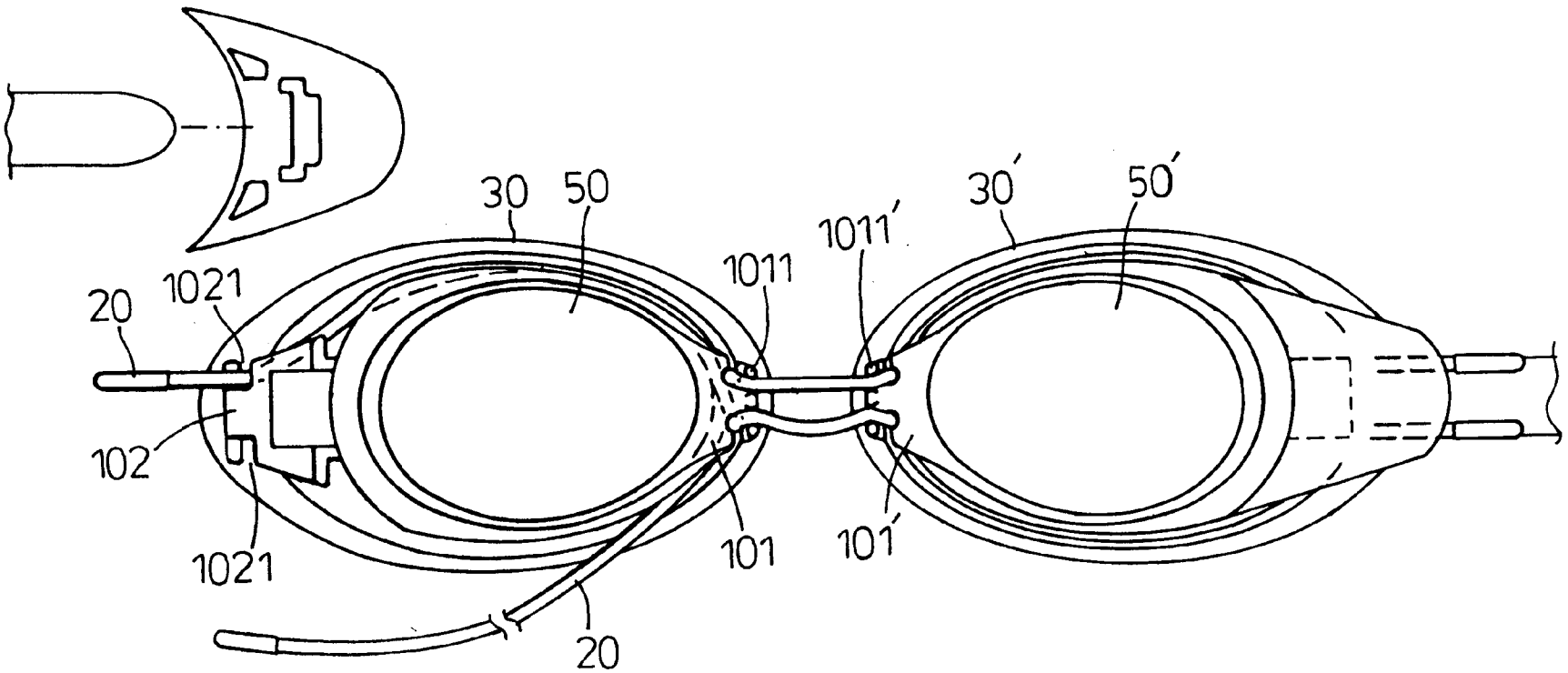
FIG.4 - B

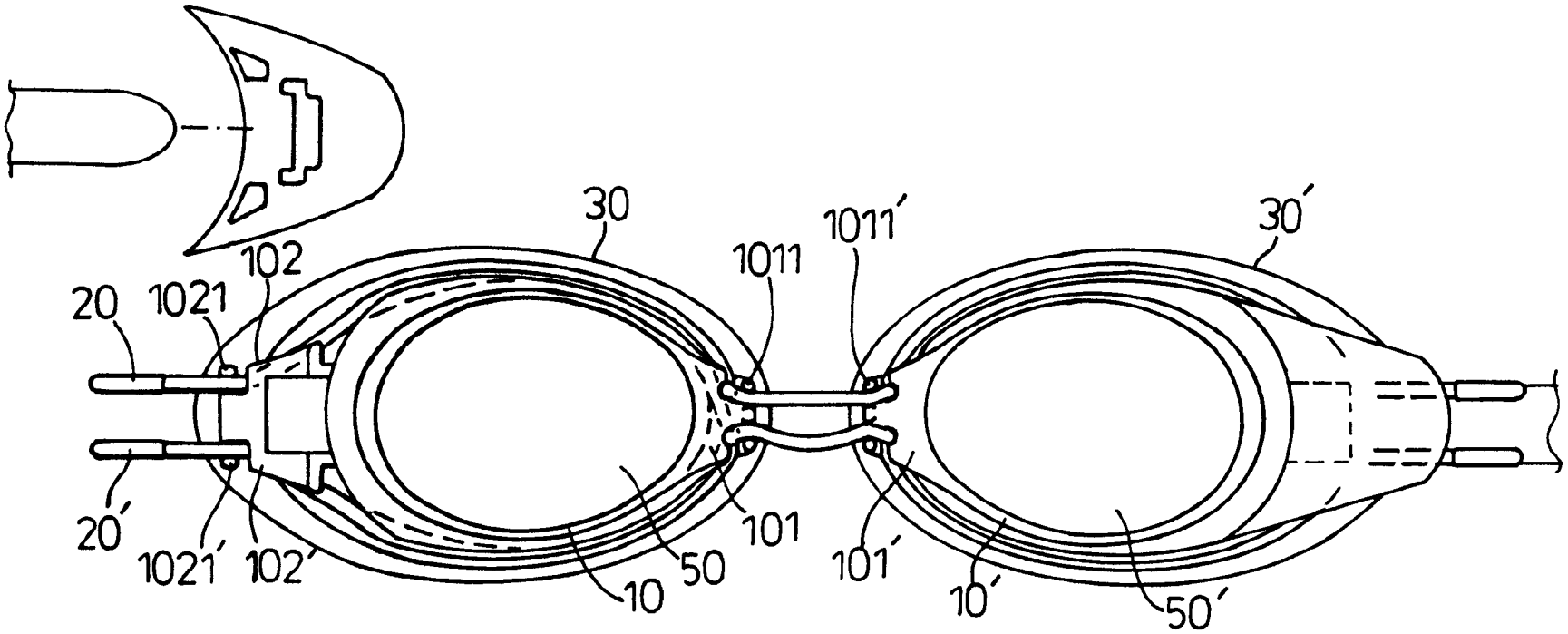
FIG.4 - C

SWIMMING GOGGLES FOR SWIMMING POOL PURPOSES

FIELD OF THE INVENTION

This invention is a model of swimming goggles for swimming pool purposes with a step-less nose bridge adjustment.

BACKGROUND OF THE INVENTION

Conventionally, a pair of swimming goggles has a span between two lens frames adjusted to suit the user's nose shape. There are only three steps in the nose bridge adjustment (as shown in FIG. 1). A conventional nose bridge has a structural checking mechanism design for adjustment . Adjustment in the natural direction will be much easier than in the reverse direction. Referring to FIG. 1, which illustrates conventional swimming goggles 5, wherein the nose bridge is a plate body 51 with several ribs 510 resting on a seat 520 of the lens frame 52. Two opposite sides of said ribs 510 are designed on a guided surface. For the checking effect, the angle of the guided surface on one side is larger. The larger angle requires much effort in adjusting the span. It would even become impossible to make the adjustment if it is operated improperly. One point that deserves attention is that, when the ribs 510 on the plate body 51 are pulled for adjustment, the ribs become compressed and deformed by the seat 520. After extended use, the ribs 510 are flattened and no longer engage the seat 520, resulting in loosening of the swimming goggles, or even the risk of water seepage. In other cases, the user may not know how to make the 3-step adjustment, so they will not feel comfortable. In view of this, it has become important for designers to present a type of swimming goggles to suit various nose ridge configurations.

BRIEF DESCRIPTION OF THE INVENTION

The primary objective of this invention is to provide a type of swimming goggles with a step-less nose bridge adjustment. Using an innovative design, the nose bridge span of the swimming goggles can be freely adjusted by the user to suit the user's nose ridge and to ensure wearing comfort.

Another objective of this invention is to provide a type of nose bridge span adjustment that uses a twitching and snapping positioning to provide operational convenience.

This swimming goggle invention is characterized by the two ends of the longer axis of the lens frames of the swimming goggles respectively have a first joining unit and a second joining unit. The formation of the nose bridge of the swimming goggles has a round string, that is positioned along the rims of the lens frames onto the first and second joining units of the two lens frames, which maintains an appropriate span between the two lens frames. In other words, the nose bridge is formed by the round string, which is connected in a series connection to the two lens frames and producing an appropriate span. Through this structural characteristic, the user may adjust the span on the round string ofthe two lens frames, to achieve nose bridge adjustment of the swimming goggles.

Through the above characteristics, the two round strings are wound on the upper and lower rims of the lens frames, with a length appropriately exposed from one end on the outside of the lens frames, to facilitate control in adjusting the span.

Through the above main characteristic, the first joining unit is located on the inside edge of the lens frame, having two round holes with openings. The second joining unit is located on the outside edge of the lens frame, having two clasping channels and a headband through the holes. These openings and channels serving to properly position the two ends of the round holes that comprise the nose bridge. Said headband through holes serves to accommodate the penetration of the headband.

Another characteristic of this invention lies in that, on the headband through hole is a fitting plate. On the said fitting plate is an embedding seat to accommodate the insertion of the headband and embed it on said headband through a hole to effectively clasp and position the headband.

Another characteristic of this invention is that between the fitting plate and the second joining unit are a first fitting unit and a second fitting unit that can be interlinked.

BRIEF DESCRIPTION OF DRAWINGS

FIGS. 4A, B and C illustrate how to adjust the span of the nose bridge in the present invention of swimming goggles.

BRIEF DESCRIPTION OF NUMERALS

| | | | |
|---|---|---|---|
| 1 | swimming goggles | 10, 10' | lens frame |
| 20, 20', 20" | round string | 3, 3' | protective pad |
| 4 | headband device | 30, 30' | face contact |
| 101, 101', 101" | first joining unit | 50, 50' | lens |
| 102, 102', 102" | second joining unit | | |
| 1011, 1011', 1011" | round hole | | |
| 1021, 1021', 1021" | clasping channel | | |
| 1022, 1022' | headband device through hole | 103, 103' | fixing groove |
| 6 | fitting plate | 60 | embedding groove |
| 61 | guide post | 62 | embedding seat |

DETAILED DESCRIPTION OF PREFERRED EMBODIMENT

Figure 1:
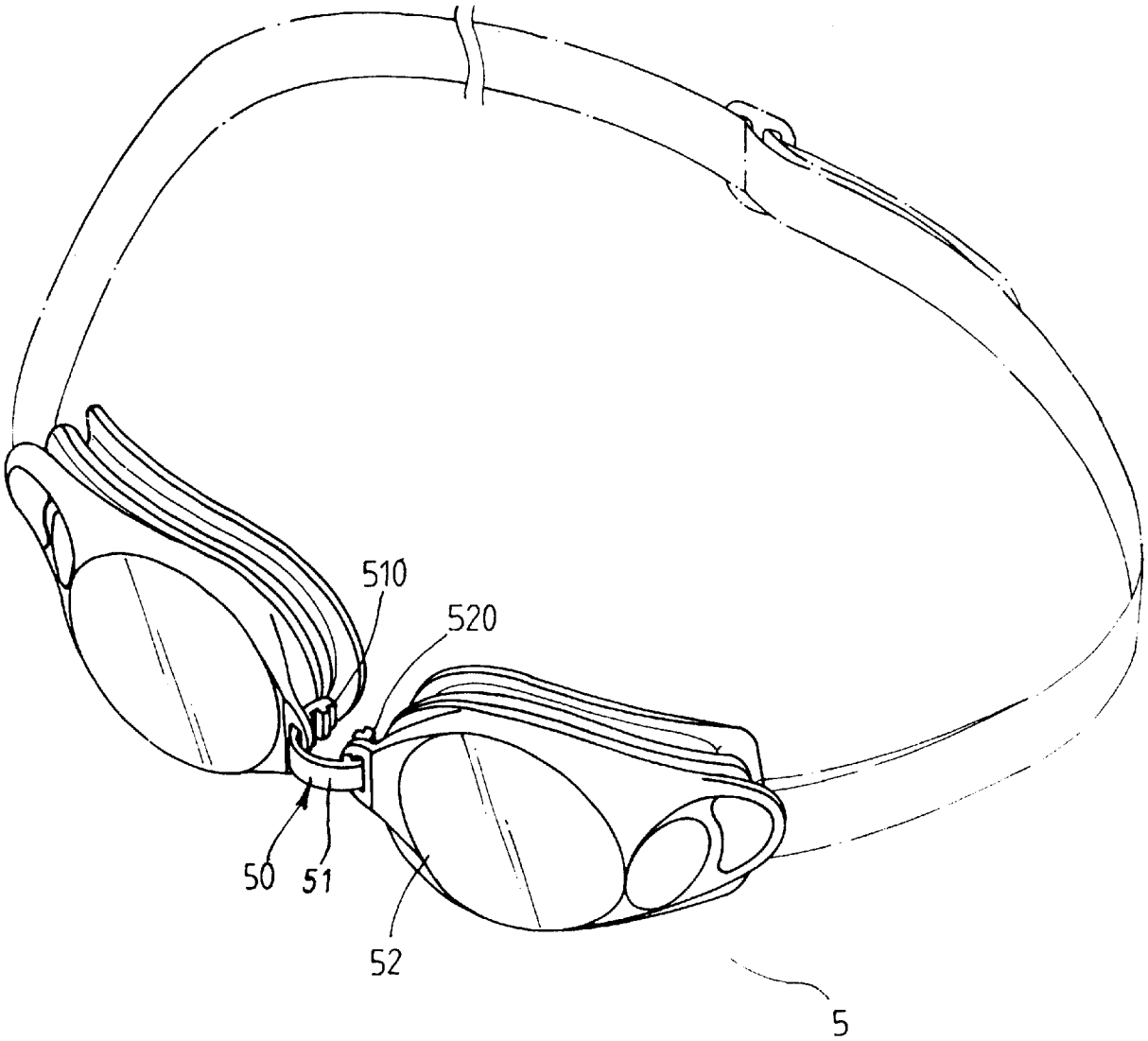
FIG. 1 is a perspective view of a conventional swimming goggle design.
Figure 2:
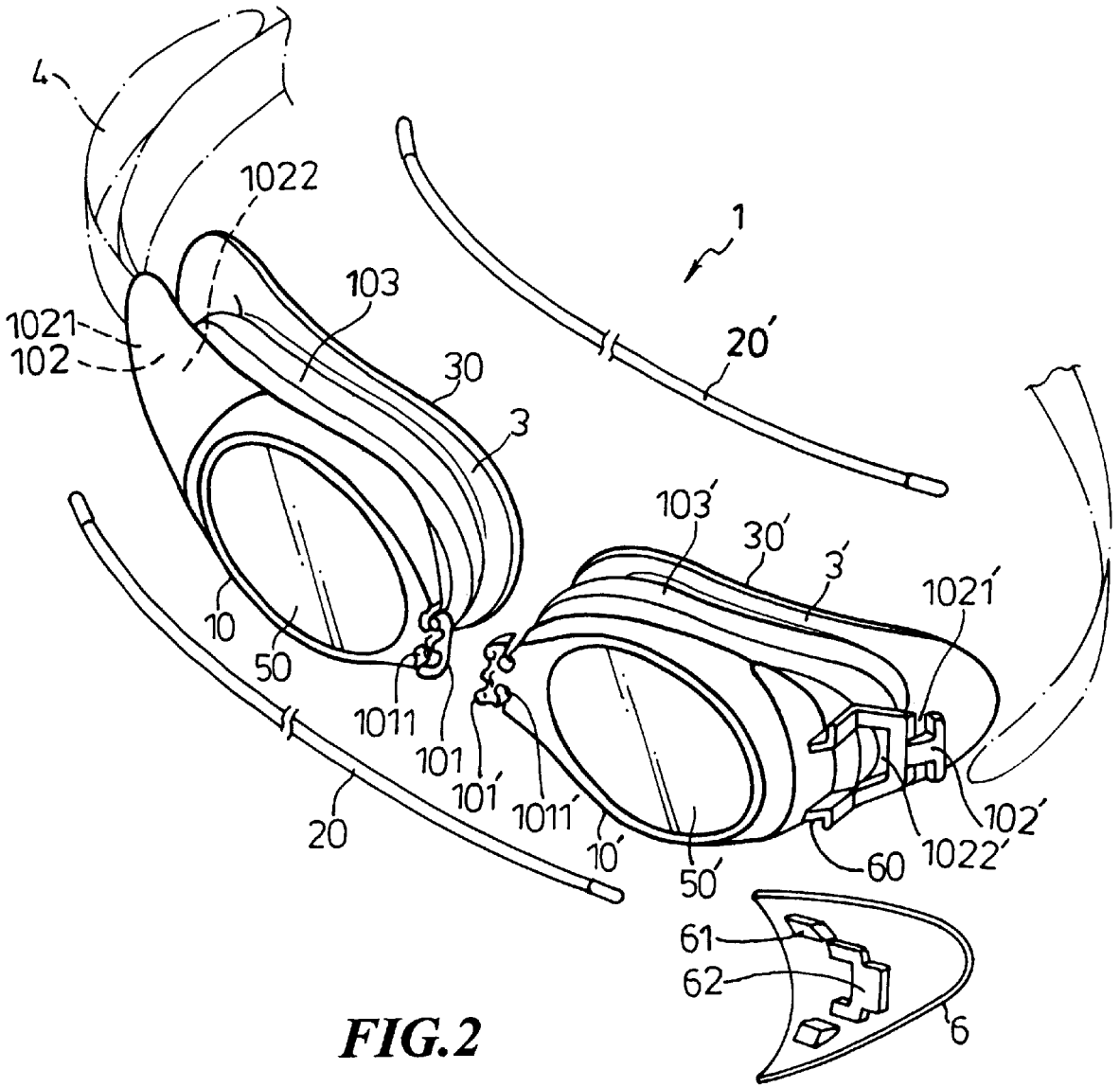
FIG. 2 is an exploded view of the present invention.

Referring to FIG. 2, this swimming goggle invention is comprised of the following: two lens frames 10 and 10', two round strings 20 and 20', two protective pads 3 and 3', and a headband device 4. The two lens frames 10 and 10' positioned to the right and left sides accommodate two lens 50 and 50'. The two lens 50 and 50' are inserted and fixed into the lens frames. On the inside ends of the two lens frames 10 and 10' are first joining units 101 and 101', on the outside ends are second joining units 102 and 102'. The first joining units 101, 101' have two round holes 1011, 1011' with openings, serving to hook the ends of two round strings 20 and 20'. The second joining units 102, 102' have two clasping channels 1021, 1021' and two headband device through holes 1022, 1022', which serves respectively to fix the other ends of the two round strings 20 and 20' and the headband device 4. The headband device through holes 1022, 1022' are designed to be fastened to the fitting plate 6 to fasten the headband device 4. Between the fitting plate 6 and the second joining units 102, 102' are a first fitting unit and a second fitting unit that can be fitted together. The first fitting unit has an embedding groove 60 located on the second joining unit, the second fitting unit has a guide post 61 on the fitting plate 6. Between the two guide posts 61 is the passage of the headband device 4.

In addition to the function of joining and positioning the headband device 4, the fitting plate 6 also has the function of obstructing the second joining units 102, 102' to provide better integral appearance to the swimming goggles. On the rims of the two lens frames 10 and 10' are two streamlined fixing grooves 103 and 103', where the two round strings 20 and 20' can be wound in position.

Made of flexible materials, the two round strings 20 and 20' respectively are inserted through the round holes 1011, 1011' and clasping channels 1021, 1021', and wound around the fixing grooves 103 and 103' on the rims of the two frames 10 and 10'. The protective pads 3, 3' are monoblock formed onto the far side of the two lens frames 10 and 10' away from the lens 50 and 50', having a face contact 30 and 30' with appropriate flexibility to enable comfortable contact with the user's face, so that water will not seep in.

Figure 3:
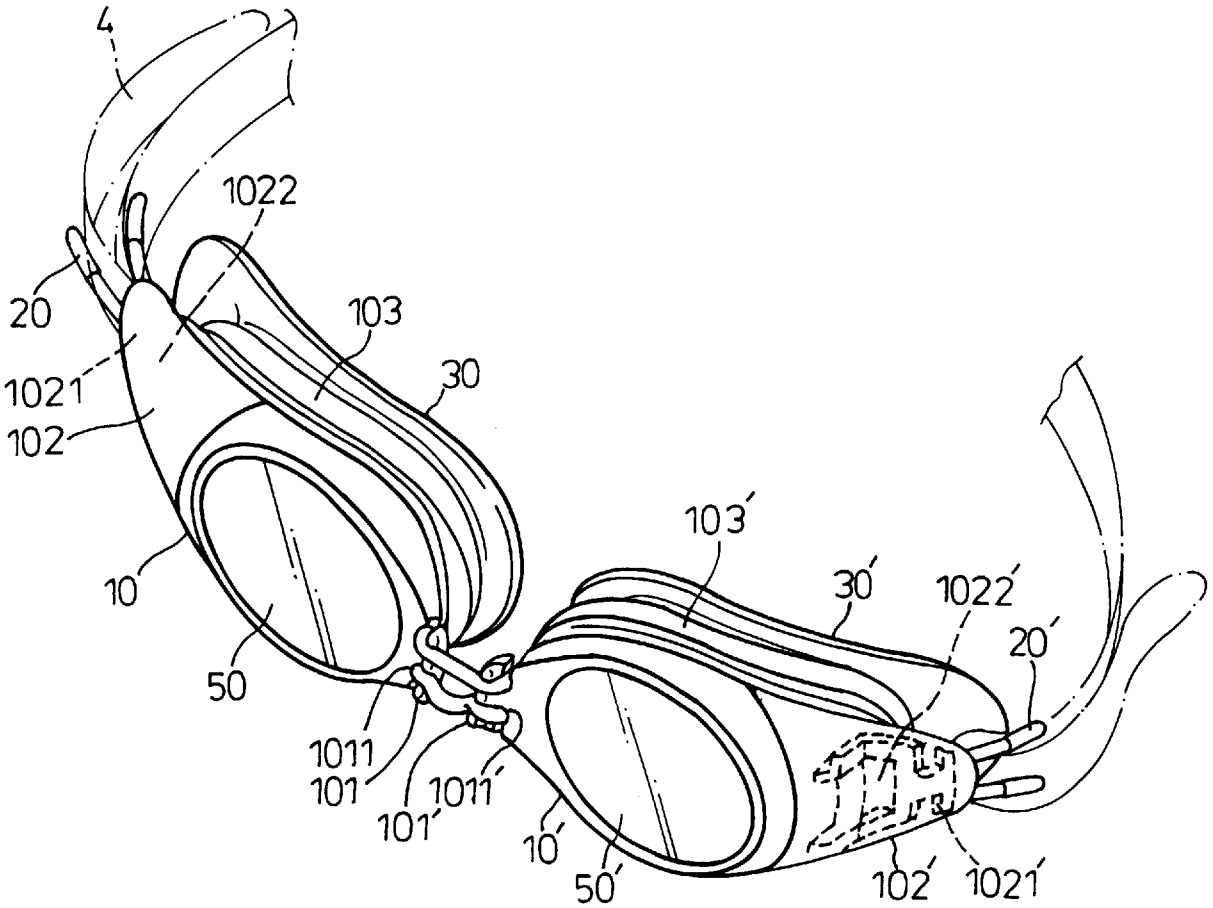
FIG. 3 is a perspective view of the present invention.

Please refer to FIG. 3. To assemble this swimming goggle invention, the following steps are followed. The part near the center of the two round strings 20 and 20' is snapped onto the round hole 1011, 1011' of the first joining unit 101, 101' on the lens frame 10, 10', then pulled along the rims of the two lens frames 10, 10' and fixed in the fixing grooves 103, 103'. Then the ends of the two round strings 20 and 20' are snapped and fixed onto the second joining unit 102, 102'. A proper span between the two lens frames is maintained, and a small section of the end of the two round strings 20 and 20' is exposed, to join the two lens frames 10, 10' as one unit. The fitting plate 6 pulls the headband device 4 to the embedding seat 62, then they are pulled to the headband device through holes 1021, 1021' of the second joining unit 102, 102', thus the invention of swimming goggles is assembled.

Please refer to FIGS. 4A, 4B and 4C which illustrates the span adjustment for this swimming goggle invention. The round string 20 (20') at one side of the second joining unit 102 (102') is pulled out to be clasped by the clasping channel 1021 (1021') (as shown in Fig. A). When the length of the upper and lower round strings 20, 20' is adjusted to suit individual needs (as shown in Fig. B), as required by the different arcs on the upper and lower parts of the user's nose ridge (as shown in FIG. 4C). The span of the nose bridge is determined by adjusting the lengths and locations of the upper and lower parts of the two round strings 20 and 20'. Therefore, in addition to step-less adjustment, it will suit the different nose ridge configurations of different users, so they can feel comfortable.

Figure 5:
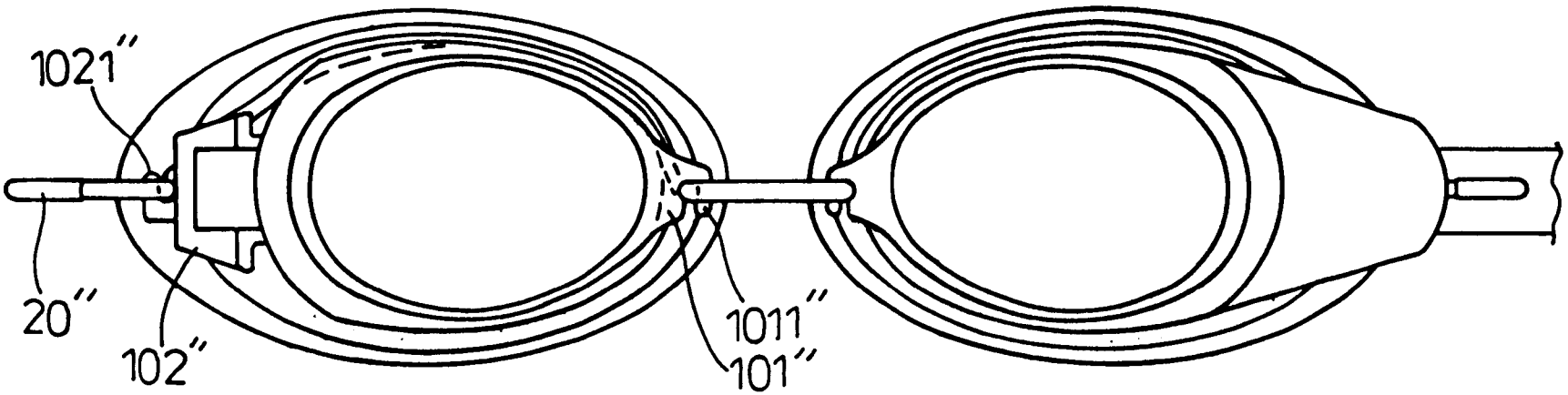
FIG. 5 is a front view of a second embodiment of the invention of swimming goggles.

Please refer to FIG. 5, which is a second preferred design of the swimming goggle invention. The second preferred design is different in that there is only one piece of round string 20". Also, there is only one round hole 1011" and one clasping channel 1021" in the first and second joining unit 101", 102". The winding of the string 20" is from the lower rim of the lens frame 10" on one side and up to the upper rim of the lens frame 10" on the other side, while its two ends are respectively fixed and clasped onto the round hole 1011" and the clasping channel 1021". Other components and assembly methods are the same as the first design. This construction will achieve the same effect of wearing comfort by step-less adjustment.

The way this swimming goggle invention assembled is innovative. The integral unit or a single lens frame unit can be bought by the user who has the option of replacing a single one-sided lens of a different style, color, etc.

Summing up, the above description covers merely some examples of preferred embodiment only. All equivalent variations and modifications deriving from the above description shall be included in the spirit and intent of the subject claims.

I claim:

1. Swimming goggles comprising:

two lens frames that each receive a lens, each one of said lens frames includes at an inner end a first joining unit and at an outer end a second joining unit;

a first string passed through said second joining unit of one of said lens frames, along an upper rim of said first one of said lens frames, through said first joining units, along an upper rim of a second one of said lens frames, and through said second joining unit of said second one of said lens frames;

a second string passed through said second joining unit of one of said lens frames, along a lower rim of said first one of said lens frames, through said first joining units, along a lower rim of a second one of said lens frames, and through said second joining unit of said second one of said lens frames; and a headband device joined to said second joining units, said headband device comprises at least a headband; wherein each said first joining unit is located at an inside edge of a corresponding lens frame, there being in each said first joining unit two round holes with openings, said openings having an outside opening that is larger than an inside opening to facilitate the insertion and fastening of the strings inside said holes, and each said second joining unit is located on an outside edge of a corresponding lens frame, each said second joining unit including two clasping channels and headband through holes, said openings and channels serving to adjustably position the two ends of said strings that configure a nose bridge.

2. The swimming goggles as recited in claim 1, wherein:

in said headband through hole on said second joining unit is a fitting plate, on said fitting plate being an embedding seat to receive said headband to effectively fix the headband in position.

3. The swimming goggles as recited in claim 2, wherein:

between each said fitting plate and each said second joining unit are a first fitting unit and a second fitting unit that can be fitted together.

4. The swimming goggles as recited in claim 3, wherein:

the first fitting unit and the second fitting unit include embedding grooves.

5. The swimming goggles as recited in claim 4, wherein:

on said upper and lower rims of each of said two lens frames are fixing grooves to receive the strings.

6. Swimming goggles, comprising:

two lens frames that each receive a lens, each one of said lens frames includes at an inner end a first joining unit and at an outer end a second joining unit;

strings sequentially threaded through said first and second joining units and said two lens frames such that said strings form a nose bridge; and a headband device connected to said second joining units on outside ends of said two lens frames, said headband device comprises at least a headband element; wherein a user adjusts separation of said two lens frames by adjusting said strings forming said nose bridge, and wherein each said first joining unit has a round hole with an opening, said opening having an outside diameter larger than an inside diameter, so as to easily receive and secure said strings therein; and each said second joining unit has a clasping channel and a headband through hole, such that said openings and said clasping channels serve to receive and secure said strings that comprise said nose bridge.

7. The swimming goggles as recited in claim 6, wherein:

said headband through holes on said second joining units are attached with fitting plates, each said fitting plate includes an embedding seat that receives said headband.

8. The swimming goggles as recited in claim 7, wherein:

between each said fitting plate and each said second joining unit are a first fitting unit and a second fitting unit that can be fitted together.

9. The swimming goggles as recited in claim 8, wherein:

said first fitting units and said second fitting units comprise embedding grooves.

10. The swimming goggles as recited in claim 9, wherein:

on said upper and lower rims of each of said two lens frames are fixing grooves to receive said strings.

11. Swimming goggles comprising:

a lens frame that receives a lens, said lens frame has a first joining unit at a first end and a second joining unit at a second end;

at least one string passing through said joining units and around said lens, said string enables said lens frame to be joined in series to another unit of said lens frame, said at least one string maintains said lens frames at a spaced position so that said swimming goggles are formed; wherein said first joining unit is located on an inside edge of said lens frame, said first joining unit having at least a round hole with an opening, said opening having an outside diameter that is larger than an inside diameter, said hole receives said at least one string string inside the hole; and said second joining unit is located on an outside edge of said lens frame, said second joining unit having at least one clasping channel and a headband through hole, said opening and said channel serving to fix in position ends of said at least one string so as to form a nose bridge.

12. The swimming goggles as recited in claim 11, wherein:

fixing grooves are included on said upper and lower rims of said lens frame to receive said at least one string.

13. The swimming goggles as recited in claim 12, wherein:

said goggles comprise a fitting plate, said fitting plate includes an embedding seat to receive a headband device.

14. The swimming goggles as recited in claim 13, wherein:

said goggles comprise a first fitting unit and a second fitting unit that can be interlinked between said fitting plate and said second joining unit.

15. The swimming goggles as recited in claim 14, wherein:

said first fitting unit and said second fitting unit comprise embedding grooves.

* * * * *